US006644017B2

(12) United States Patent
Takahashi et al.

(10) Patent No.: US 6,644,017 B2
(45) Date of Patent: Nov. 11, 2003

(54) DEVICE FOR AND METHOD OF CONTROLLING AIR-FUEL RATIO OF INTERNAL COMBUSTION ENGINE

(75) Inventors: Koji Takahashi, Atsugi (JP); Shigeo Ohkuma, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 10/005,336

(22) Filed: Dec. 7, 2001

(65) Prior Publication Data

US 2002/0073965 A1 Jun. 20, 2002

(30) Foreign Application Priority Data

Dec. 8, 2000 (JP) ..... 2000-373849

(51) Int. Cl.[7] ..... F01N 3/00

(52) U.S. Cl. ..... 60/285; 60/274; 60/276; 123/436; 701/103

(58) Field of Search ..... 60/274, 276, 277, 60/285; 123/435, 436; 701/109, 105

(56) References Cited

U.S. PATENT DOCUMENTS 5,363,091 A * 11/1994 Kotwicki et al. ..... 340/439
5,437,154 A * 8/1995 Sato et al. ..... 60/276
5,850,815 A * 12/1998 Yano et al. ..... 123/417
6,142,012 A * 11/2000 Schneider et al. ..... 73/118.1
6,314,724 B1 * 11/2001 Kakuyama et al. ..... 60/285

FOREIGN PATENT DOCUMENTS

JP 6-249028 9/1994
JP 10-184425 7/1998

* cited by examiner

*Primary Examiner*—Thomas Denion
*Assistant Examiner*—Binh Tran
(74) *Attorney, Agent, or Firm*—McDermott, Will & Emery

(57) ABSTRACT

In a system in which an oxygen quantity stored in a catalytic converter is estimated to feedback control a fuel injection quantity based on the estimated oxygen quantity, when a predetermined period of time has not yet passed from an occurrence of misfire and from the end of misfire, the update of the oxygen quantity is suspended, and also, when the predetermined period of time has not yet passed from the end of misfire, the fuel injection quantity is decreasingly corrected and the oxygen quantity is reset after the predetermined period of time has passed.

16 Claims, 5 Drawing Sheets

DEVICE FOR AND METHOD OF CONTROLLING AIR-FUEL RATIO OF INTERNAL COMBUSTION ENGINE

BACKGROUND OF THE INVENTION

1. Field of the Invention

The present invention relates to a device for and method of controlling an air-fuel ratio of an internal combustion engine having a constitution to control an air-fuel ratio of a combustion mixture based on an oxygen quantity stored in a catalytic converter.

2. Related Art of the Invention

There has heretofore been known a device for controlling an air-fuel ratio having a constitution to estimate an oxygen quantity stored in a catalytic converter based on an air-fuel ratio detected by an oxygen sensor disposed on the upstream side of the catalytic converter and on an exhaust gas quantity, and to control an air-fuel ratio of a combustion mixture so that the oxygen quantity reaches a target value (refer to Japanese Unexamined Patent Publication Nos. 6-249028 and 10-184425).

When a misfire occurs in the engine, the atmospheric air directly flows into an exhaust pipe. Accordingly, the oxygen sensor detects a high oxygen concentration and from the detection result, it is judged that the oxygen quantity in the catalytic converter is increasingly changed.

When a misfire occurs, however, fuel injected into the engine flows without burned into the exhaust pipe and, hence, the unburned fuel is subjected to the oxidation reaction in the catalytic converter resulting in the much consumption of oxygen.

In practice, therefore, although the oxygen quantity is not largely changed to increase, an estimation value of the oxygen quantity is increasingly changed based on the detection result by the oxygen sensor. Accordingly, the air-fuel ratio is controlled to be rich so as to decrease the oxygen quantity thereby causing such a problem that the oxygen quantity is controlled to a value smaller than a target value.

When a misfire occurs, further, since a large quantity of fuel is subjected to the oxidation reaction in the catalytic converter, and the oxygen stored In the catalytic converter is abruptly consumed, an actual oxygen quantity is rather decreased.

Accordingly, if the air-fuel ratio is controlled to be rich based on the fact that the estimation value of oxygen quantity is increasingly changed on the basis of the result detected by the oxygen sensor, the reduction of oxygen quantity is further accelerated.

Besides, even if an erroneous control of air-fuel ratio can be avoided, a decreasing change in the actual oxygen quantity due to the oxidation reaction of fuel in the catalytic converter cannot be estimated from the exhaust gas quantity or the oxygen concentration. Accordingly, the actual oxygen quantity remains smaller than the target value causing an error in estimating the oxygen quantity.

SUMMARY OF THE INVENTION

It is therefore an object of the present invention to avoid that an unnecessary rich control operation is performed based on a detection result of oxygen concentration in the exhaust gas when a misfire has occurred.

It is another object of the present invention to quickly return an actual oxygen quantity back to a target value and to maintain estimation accuracy of oxygen quantity even in case the actual oxygen quantity is decreased due to the oxidation reaction of fuel in a catalytic converter when a misfire has occurred by.

In order to accomplish the above objects, according to the present invention, in a construction where an oxygen quantity stored in a catalytic converter is estimated based on an exhaust gas quantity and on an oxygen concentration in the exhaust gas, and a fuel injection quantity is feedback controlled so that the estimation value of oxygen quantity approaches a target quantity, when an occurrence of misfire is detected, a control of the fuel injection quantity based on the oxygen concentration detected at that time is prohibited.

Further, according to the present invention, the construction is such that, for a predetermined period of time from the end of misfire following the time when the occurrence of misfire is detected, the control of the fuel injection quantity based on the oxygen concentration detected at that time is also prohibited, and also the fuel injection quantity is forcibly corrected to decrease for the predetermined period of time from the end of misfire, and further, after the end of the decreasing correction, the estimated value of oxygen quantity is reset to a preset value.

The other objects and features of this invention will become understood from the following description with reference to the accompanying drawings.

PREFERRED EMBODIMENT

Figure 1:
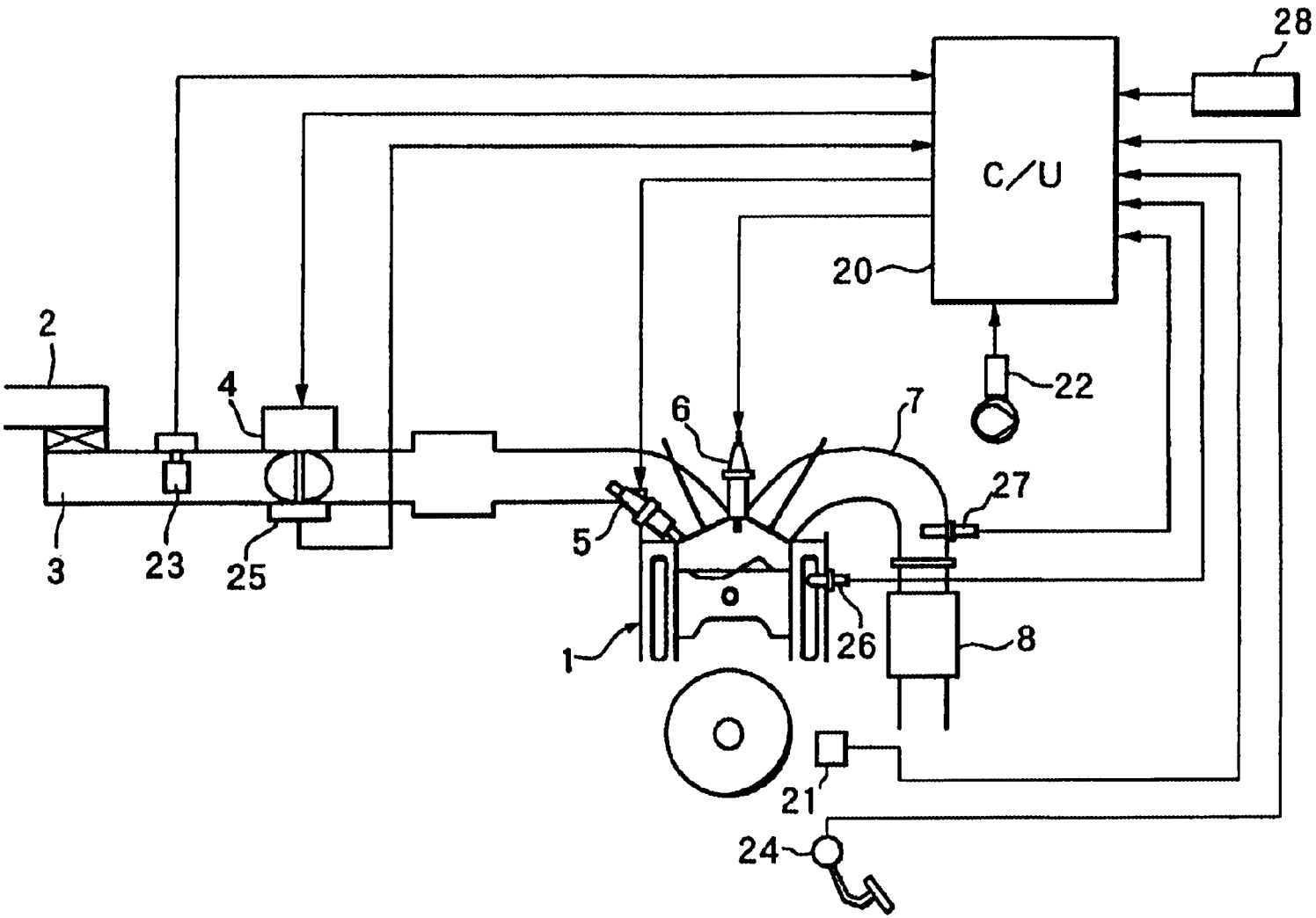
FIG. 1 is a diagram showing a system structure of an internal combustion engine.

FIG. 1 is a diagram showing a system structure of an internal combustion engine according to an embodiment.

In FIG. 1, air is sucked into a combustion chamber in each cylinder of an internal combustion engine 1 mounted on a vehicle through an air cleaner 2, an intake pipe 3 and an electronically controlled throttle valve 4 driven to open and close by a motor.

An electromagnetic fuel injection valve 5 is provided for directly injecting fuel into the combustion chamber in each cylinder, and an air-fuel mixture is formed in the combustion chamber by the fuel injected from fuel injection valve 5 and the intake air.

Fuel injection valve 5 is opened by the supply of power to the solenoid thereof by an injection pulse signal output from a control unit 20, to inject fuel adjusted to a predetermined pressure.

The air-fuel mixture formed in the combustion chamber is ignited to burn by an ignition plug 6.

Here, internal combustion engine 1 is not limited to only a direct cylinder fuel injection type gasoline engine but may be an internal combustion engine having a constitution in which fuel is injected into an intake port.

The exhaust gas from engine 1 is emitted through an exhaust pipe 7. Exhaust pipe 7 is provided with a catalytic converter 8 for purifying the exhaust gas.

Catalytic converter 8 is a three-way catalytic converter having an ability for storing oxygen, and works to oxidize carbon monoxide CO and hydrocarbons HC, and works to reduce nitrogen oxide NOx, which are the three harmful components in the exhaust gas, to convert them into harmless carbon dioxide, water vapor and nitrogen.

Three-way catalytic converter 8 exhibits the highest purifying performance when an air-fuel ratio of the exhaust gas is a stoichiometric air-fuel ratio. When an air-fuel ratio of the exhaust gas is lean and an oxygen quantity in the exhaust gas is excessive, the oxidizing action becomes active but the reduction action becomes inactive. Conversely, when the air-fuel ratio of the exhaust gas is rich and the oxygen quantity is less, the oxidizing action becomes inactive but the reduction action becomes active.

However, since three-way catalytic converter 8 has the ability for storing oxygen, when the air-fuel ratio of the exhaust gas becomes temporarily rich, the oxygen that has been stored in three-way catalytic converter 8 up to that time is used, on the other hand, when the air-fuel ratio of the exhaust gas becomes temporarily lea, excess oxygen is stored to maintain the exhaust gas purifying performance.

Accordingly, in order that nitrogen oxide NOx can be reduced when the air-fuel ratio is shifted to a lean side from the stoichiometric air-fuel ratio and that carbon monoxide CO and hydrocarbons HC can be oxidized when the air-fuel ratio is shifted to a rich side from the stoichiometric air-fuel ratio, it is required that the oxygen quantity stored in three-way catalytic converter 8 is maintained to be about a half the maximum quantity that can be stored, so that excess oxygen can be newly stored so as to eliminate and supply oxygen necessary for the oxidation treatment.

Therefore, control unit 20 estimates the oxygen quantity stored in the three-way catalytic converter 8 in a predetermined operation region, to feedback control the fuel injection quantity by fuel injection valve 5 so that the air-fuel ratio is shifted to be lean to increase the oxygen quantity when the estimation value of oxygen quantity is less than a target quantity, and conversely, the air-fuel ratio is shifted to be rich to decrease the oxygen quantity by eliminating excess oxygen when the estimation value of oxygen quantity is larger than the target quantity.

Control unit 20 incorporates therein a microcomputer including a CPU, a ROM, a RAM, an AID converter and an input/output interface. Control unit 20 receives signals from various sensors, and executes the computing process based on these signals to control the opening of electronically controlled throttle valve 4, the injection quantity and injection timing by fuel injection valve 5, and the ignition timing by ignition plug 6.

The above various sensors may include a crank angle sensor 21 for detecting a crank angle of engine 1 and a cam sensor 22 for taking out a cylinder discrimination signal from the camshaft. A rotation speed Ne of engine is calculated based on a signal from crank angle sensor 21.

Other than the above, there are further provided an airflow meter 23 for detecting an intake air quantity Q at the upstream side of throttle valve 4 in intake pipe 3, an accelerator sensor 24 for detecting a depression amount APS of accelerator pedal, a throttle sensor 25 for detecting the opening TVO of throttle valve 4, a water temperature sensor 26 for detecting the cooling water temperature Tw of engine 1, an oxygen sensor 27 for detecting an oxygen concentration in the exhaust gas over a wide range at the upstream side of three-way catalytic converter 8, and a vehicle speed sensor 28 for detecting the vehicle steed VSP.

Here, an air-fuel ratio control to be executed by control unit 20 will be described with reference to a block diagram of FIG. 2.

Figure 2:
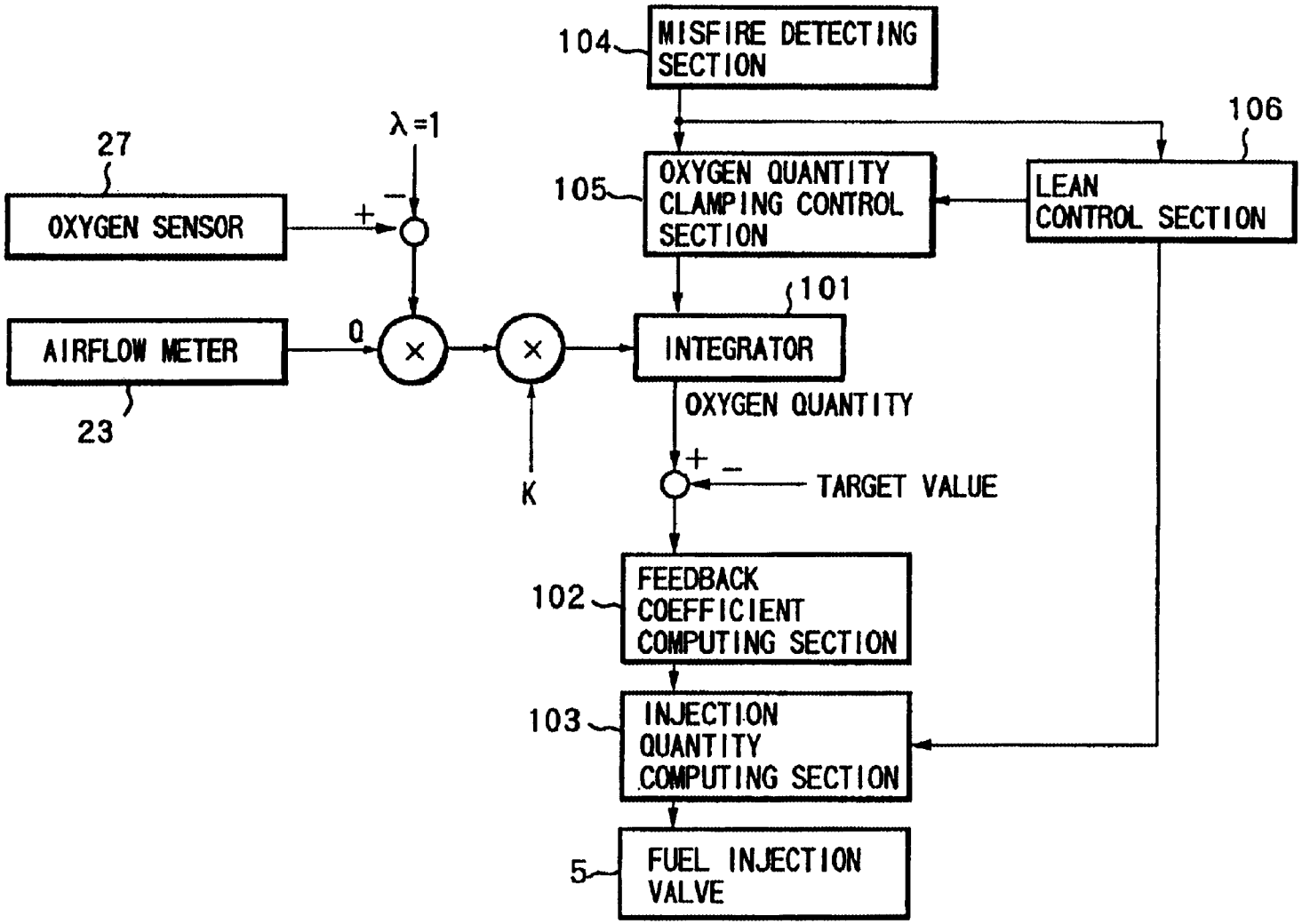
FIG. 2 is a block diagram showing an air-fuel ratio control in a first embodiment.

In the block diagram of FIG. 2, data of the intake air quantity Q detected by airflow meter 23 is multiplied by a deviation $\Delta\lambda$ between the stoichiometric air-fuel ratio and the air-fuel ratio detected by oxygen sensor 27.

The deviation $\Delta\lambda$ in the air-fuel ratio becomes a positive value when the air-fuel ratio of the combustion mixture is leaner than the stoichiometric air-fuel ratio, and becomes a negative value when the air-fuel ratio of the combustion mixture is richer than the stoichiometric air-fuel ratio, that is, the deviation $\Delta\lambda$ is changed in response to that the oxygen quantity in catalytic converter 8 is increasingly changed when the air-fuel ratio of the combustion mixture is leaner than the stoichiometric air-fuel ratio and that the oxygen quantity in catalytic converter 8 is decreasingly changed when the air-fuel ratio of the combustion mixture is richer than the stoichiometric air-fuel ratio.

The intake air quantity Q detected by airflow meter 23 is used as an approximate value of the exhaust gas quantity, and may be obtained by directly measuring the exhaust gas quantity. It is preferable to bring the intake air quantity Q more close to the exhaust gas quantity by performing a correction by exhaust gas recirculation or a transient correction on the intake air quantity Q.

The multiplication result of the intake air quantity Q and the air-fuel ratio deviation $\Delta\lambda$ is further multiplied by a constant K. This multiplication result is successively integrated by an integrator 101 to obtain the oxygen quantity stored in catalytic converter 8.

Next, a deviation is calculated between the estimation value of oxygen quantity output from integrator 101 and a target value of about a half the maximum oxygen quantity.

A feedback coefficient computing section 102 input with data related to the deviation of the oxygen quantity, computes a feedback correction coefficient for the air-fuel ratio so as to coincide the estimation value of oxygen quantity with a target value.

That is, the feedback correction coefficient is so set that the air-fuel ratio is shifted to be lean to increase the oxygen quantity when the oxygen quantity is less than the target quantity, and conversely, that the air-fuel ratio is shifted to be rich to decrease the oxygen quantity by eliminating excess oxygen when the oxygen quantity is larger than the target quantity.

An injection quantity computing section 103 corrects a basic fuel injection quantity by using the feedback correction coefficient to compute a final fuel injection quantity, and outputs an injection pulse signal corresponding to the final fuel injection quantity to fuel injection valve 5.

A misfire detecting section 104 detects a misfire based on a fluctuation in the engine rotation speed Ne.

However, a method of detecting misfire is not limited to the method of detecting misfire based on the rotation fluctuation, there can be also employed any known method of detecting misfire, such as a constitution for detecting misfire based on the cylinder pressure or a constitution for detecting misfire from the light of combustion.

An oxygen quantity cramping control section 105 suspends the updating of the oxygen quantity when an occurrence of misfire is detected by misfire detecting section 104.

Further, a lean control section 106 output a lean correction signal to injection quantity computing section 103 to forcibly shift the air-fuel ratio to be lean for only a predetermined period of time from a moment when the end of misfire is detected by misfire detecting section 104.

Lean control section 106 outputs a signal representing the end of forcible lean control to oxygen quantity cramping control section 105. Upon receiving the lean control end signal, cramp control unit 105 resets the estimation value of oxygen quantity to a predetermined value and, then, resumes the processing for updating.

The processing in misfire detecting section 104, oxygen quantity cramping control section 105 and lean control section 106 will now be described in detail with reference to a flowchart of FIG. 3.

Figure 3:
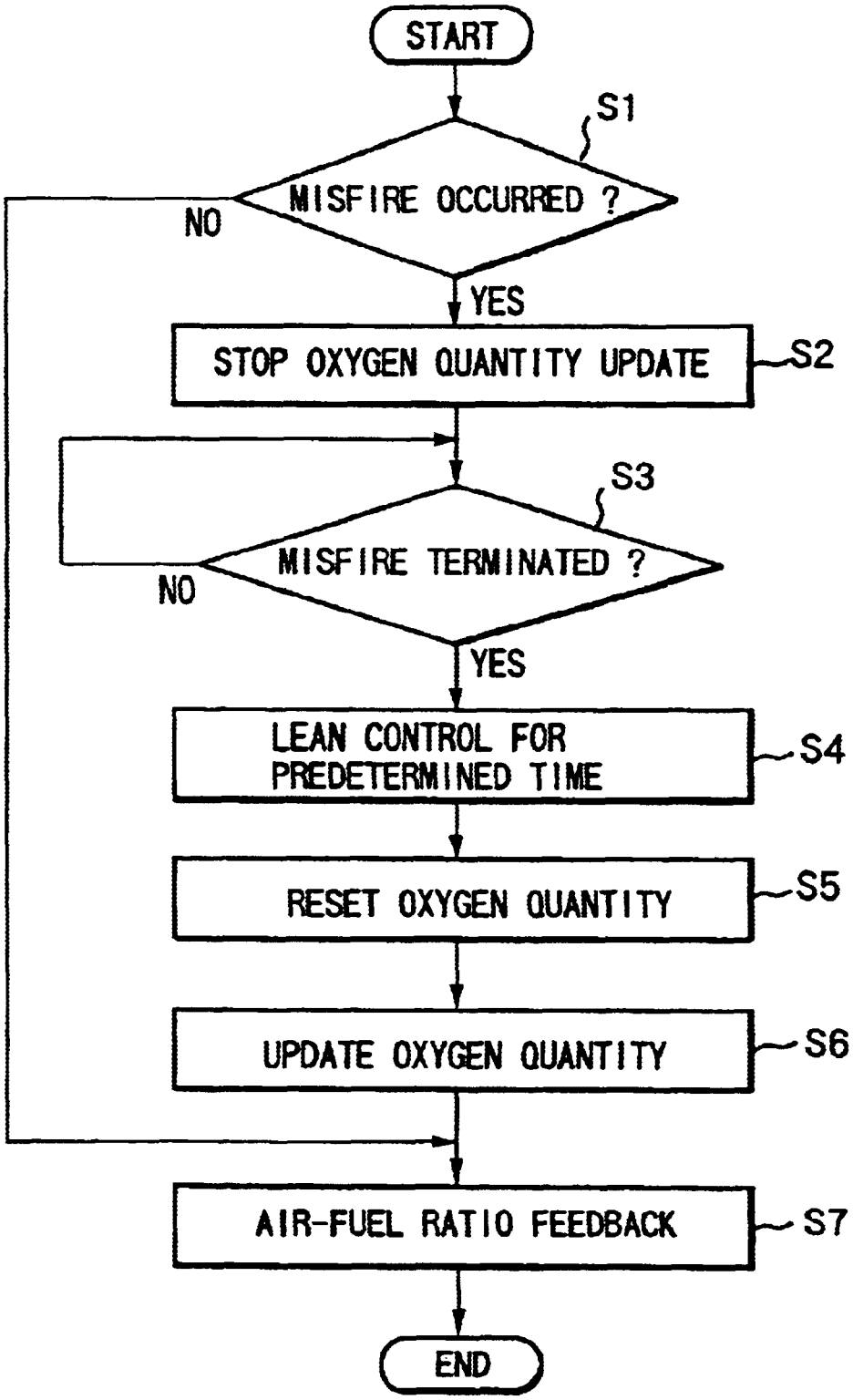
FIG. 3 is a flowchart showing an air-fuel ratio control of when a misfire has occurred in the first embodiment.

In the flowchart of FIG. 3, it is judged at step S1 whether a misfire has occurred.

In a state where no misfire occurs, the procedure jumps to step S6 where the estimation value of oxygen quantity is normally updated. At next step S7, the feedback control is performed based on the estimation value of oxygen quantity.

When the occurrence of misfire is detected at step S1, the procedure advances to step S2 where the update of the estimation value of oxygen quantity based on the intake air quantity (≈exhaust gas quantity) and the air-fuel ratio deviation $\Delta\lambda$ is suspended.

At step S3, it is judged whether the misfire has ended. After the end of misfire, the procedure advances to step S4.

At step S4, the fuel injection quantity is corrected so as to forcibly shift the air-fuel ratio of the combustion mixture to be lean for a predetermined period of time.

The above predetermined period of time may be a fixed value. Preferably, however, the predetermined period of time is varied depending on the number of times the misfire has occurred, duration of the misfire, total quantity of fuel injected during the misfire and, further, on the operation conditions such as the intake air quantity and the rotation speed.

If the predetermined period of time is set based on the number of times the misfire has occurred, duration of the misfire and the total quantity of fuel injected during the misfire, there may be a case where 0 is set as the predetermined period of time when the misfire ends within an extremely short period of time and there is no need of effecting the lean correction, and the lean correction is not substantially performed.

When 0 is set as the predetermined period of time, the procedure advances to step S5 and the followings simultaneously with the end of misfire.

After the lean correction for the predetermined period of time at step S4 is finished, the procedure advances to step S5 where the estimation value of oxygen quantity is reset to a preset value.

The above preset value is set to the target value or a value near the target value in the feedback control.

In this manner, after the lean correction for the predetermined period of time is finished, the preset value is set to an initial value, and the update of the estimation value of oxygen quantity is resumed.

When the misfire occurs, oxygen sensor 27 detects a lean state. If the update of the estimation value of oxygen quantity is normally continued, the estimation value of oxygen quantity is updated in an increasing direction. Therefore, the air-fuel ratio is shifted to be rich to suppress the increasing change. In this case, however, the fuel is injected unlike the case of when the fuel is cutoff. Accordingly, an actual oxygen quantity is not increasingly changed due to the oxidation reaction of fuel in catalytic converter 8.

By suspending the update of the estimation value of oxygen quantity when the misfire occurs, even when oxygen sensor 27 has detected the lean state, the estimation value of oxygen quantity is prevented from being updated to the increasing direction, thereby avoiding unnecessary rich control based on the lean detection by oxygen sensor 27.

The actual oxygen quantity during the misfire is quickly consumed by the oxidation reaction in the catalytic converter of fuel flowing out from the combustion chamber due to misfire. Therefore, the oxygen quantity tends to be decreased compared to the oxygen quantity before the misfire has occurred. In order to compensate for a decreased quantity, therefore, the air-fuel ratio after the end of misfire is shifted to be lean by a predetermined period of time. After the lean control of the air-fuel ratio is finished, it is estimated that the actual oxygen quantity is near the predetermined value (target value), to reset the estimation value of oxygen quantity.

Thereby, it becomes possible to quickly return the actual oxygen quantity to near the target value and to maintain the accuracy of estimating the oxygen quantity after the update is resumed.

In the above-mentioned embodiment, the update of the estimation value of oxygen quantity is suspended when the misfire has occurred, to avoid the air-fuel ratio control based on an incorrect estimation value. However, the construction may be such that an incorrect control can be avoided by suspending the air-fuel ratio based an the oxygen quantity, even when the oxygen quantity is erroneously estimated.

Figure 4:
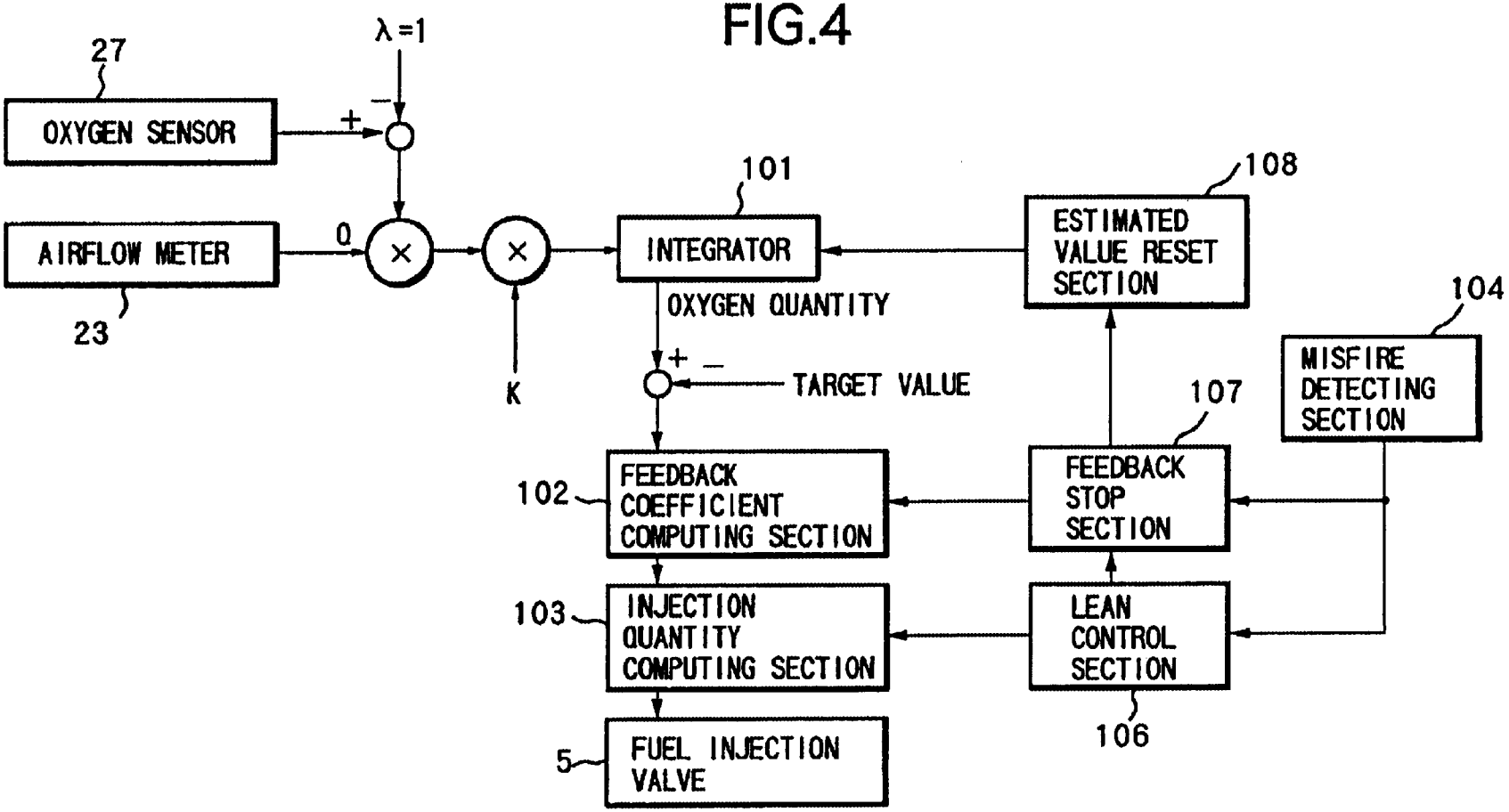
FIG. 4 is a block diagram showing an air-fuel ratio control in a second embodiment.

A block diagram of FIG. 4 shows a second embodiment in which the air-fuel ratio control based on the estimation value of oxygen quantity is suspended when the misfire has occurred.

In the block diagram of FIG. 4, the same elements as those of the block diagram of FIG. 2 are denoted by the same reference numerals and the detailed explanation thereof are omitted.

In the block diagram of FIG. 4, when the occurrence of misfire is detected by misfire detecting section 104, a feedback stop section 107 stops the feedback control operation in feedback coefficient computing section 102.

When the end of misfire is detected by misfire detecting section 104, lean control section 106 forcibly shifts the air-fuel ratio to be lean by a predetermined period of time.

After the lean control by lean control section 106 is finished, feedback stop section 107 resumes the feedback control. Here, at the same time, an estimated value reset section 108 resets the estimation value of oxygen quantity to a preset value, whereby the estimation value is updated with the preset value as an initial value, and the feedback control is performed by using the updated estimation value.

Figure 5:
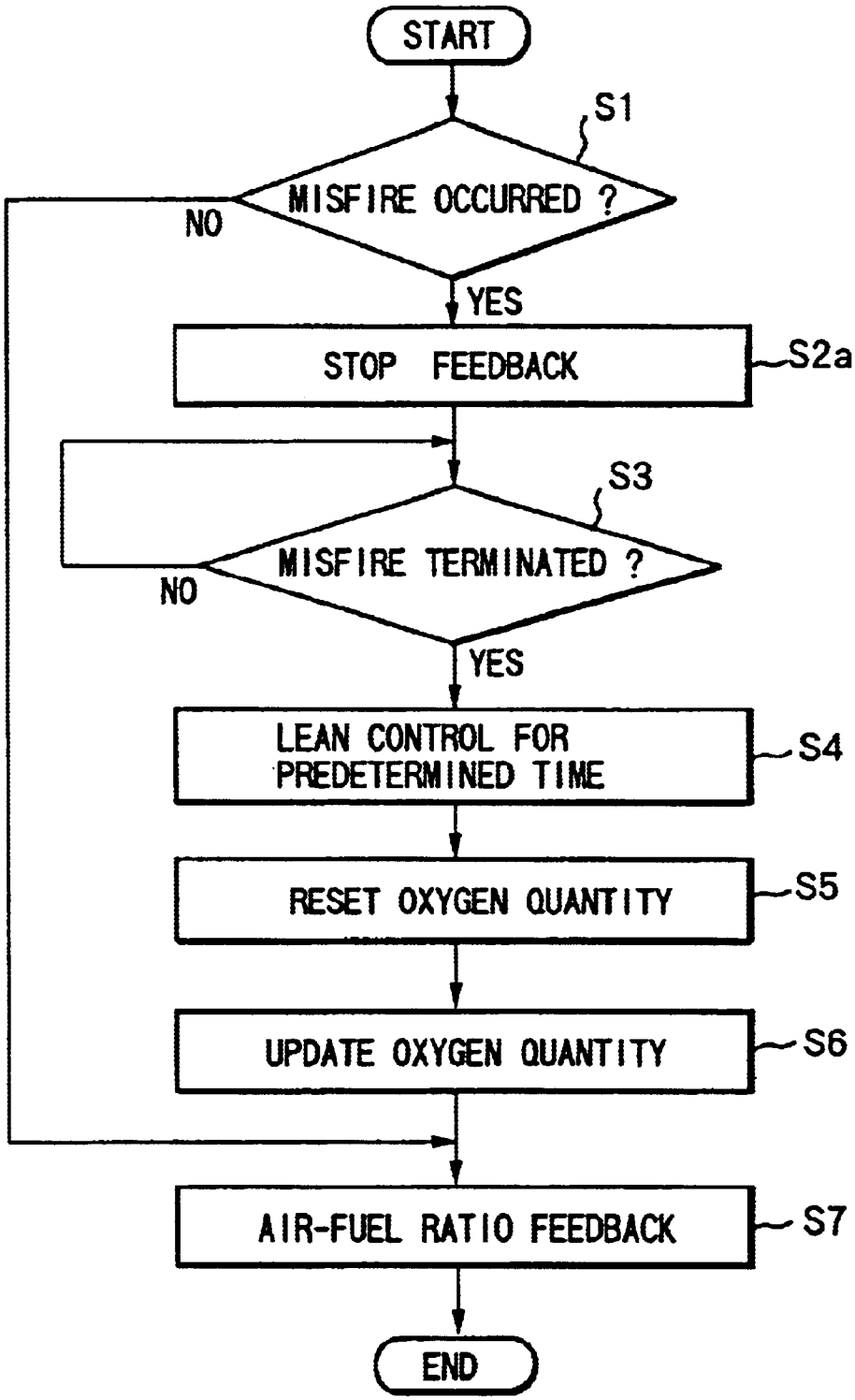
FIG. 5 is a flowchart showing an air-fuel ratio control of when a misfire has occurred in the second embodiment.

A flowchart of FIG. 5 shows in detail the control of when a misfire has occurred in the second embodiment, and corresponds to the flowchart of FIG. 3 except for step S2*a*.

That is, in the second embodiment, when the misfire occurs (S1), the feedback control is stopped at step S2*a*.

Therefore, even when the oxygen quantity is estimated to be larger than the actual quantity due to misfire, the air-fuel ratio is not corrected in a rich direction based such an estimation value, so as to avoid that the actual oxygen quantity is controlled to be a value less than the target quantity.

When the misfire ends (S3), the air-fuel ratio is forcibly shifted to be lean by a predetermined period of time (S4) like in the first embodiment, to recover an oxygen quantity that was consumed by the oxidation reaction of fuel injected during the misfiring.

After the end of the lean control, the estimation value of oxygen quantity is reset to a predetermined value to thereby change the estimated value to a value approximate to an actual value (S5) and to resume the feedback control based on the estimated value (S6, S7).

The entire contents of Japanese Patent Application No. 2000-373849, filed Dec. 8, 2000 are incorporated herein by reference.

What is claimed:

1. A device for controlling an air-fuel ratio of an internal combustion engine comprising;

a fuel injection valve for injecting fuel to said engine;

a catalytic converter disposed in an exhaust pipe of said engine;

an exhaust gas quantity sensor for detecting an exhaust gas quantity of said engine;

an oxygen sensor disposed in the exhaust pipe on the upstream side of said catalytic converter for detecting an oxygen concentration in the exhaust gas;

an oxygen quantity estimating unit that estimates an oxygen quantity stored in said catalytic converter based on said exhaust gas quantity and said oxygen concentration;

a feedback control unit that feedback controls a fuel injection quantity by said fuel injection valve, so that said oxygen quantity approaches a target quantity;

a misfire detecting unit that detects a misfire in said engine;

a misfire period control prohibiting unit that, when an occurrence of misfire is detected, prohibits said fuel injection quantity control based on the oxygen concentration detected at that moment;

a post misfire control prohibiting unit that prohibits said fuel injection quantity control based on the oxygen concentration detected at that moment, for a predetermined period of time from the end of misfire;

a decreasing correction unit that forcibly corrects the fuel injection quantity to be decreased for said predetermined period of time from the end of misfire; and a control starting unit that starts the fuel injection quantity control based on said oxygen quantity at the end of the forcible decreasing correction of said fuel injection quantity.

2. The device for controlling an air-fuel ratio of an internal combustion engine according to claim 1, wherein said misfire period control prohibiting unit and said post misfire control prohibiting unit suspend the update of the oxygen quantity in said oxygen quantity estimating unit.

3. The device for controlling an air-fuel ratio of an internal combustion engine according to claim 1, wherein said misfire period control prohibiting unit and said post misfire control prohibiting unit stop the feedback control of said feedback control unit.

4. The device for controlling an air-fuel ratio of an internal combustion engine according to claim 1, further comprising;

a prohibition time setting unit that sets said predetermined period of time based on a state of misfiring.

5. The device for controlling an air-fuel ratio of an internal combustion engine according to claim 1, further comprising:

a reset unit that resets said oxygen quantity to said target quantity at the end of the forcible decreasing correction of said fuel injection quantity.

6. The device for controlling an air-fuel ratio of an internal combustion engine according to claim 1, wherein said exhaust gas quantity sensor is an airflow meter for detecting an engine intake air quantity, which is approximate to the exhaust gas quantity.

7. The device for controlling an air-fuel ratio of an internal combustion engine according to claim 1, wherein said misfire detecting unit detects an occurrence of misfire based on a fluctuation in a rotation speed of the engine.

8. The device for controlling an air-fuel ratio of an internal combustion engine according to claim 1, wherein said oxygen quantity estimating unit estimates the oxygen quantity stored in said catalytic converter based on a deviation between a stoichiometric air-fuel ratio and an air-fuel ratio corresponding to said oxygen concentration and said exhaust gas quantity.

9. The device for controlling an air-fuel ratio of an internal combustion engine according to claim 1, further comprising:

a reset unit that resets the estimation value of said oxygen quantity to a preset value at the end of the forcible decreasing correction of said fuel injection quantity.

10. A device for controlling an air-fuel ratio of an internal combustion engine, comprising:

fuel injection means for injecting fuel to said engine;

a catalytic converter disposed in an exhaust pipe of said engine;

exhaust gas quantity detecting means for detecting an exhaust gas quantity of said engine;

oxygen concentration detecting means for detecting an oxygen concentration in the exhaust gas at the upstream side of said catalytic converter;

oxygen quantity estimating means for estimating an oxygen quantity stored in said catalytic converter based on said exhaust gas quantity and said oxygen concentration;

feedback control means for feedback controlling a fuel injection quantity by said fuel injection valve, so that said oxygen quantity approaches a target quantity;

misfire detecting means for detecting a misfire in said engine;

misfire period control prohibiting means for, when an occurrence of misfire is detected, prohibiting said fuel injection quantity control based on the oxygen concentration detected at that moment;

post misfire control prohibiting means for prohibiting said fuel injection quantity control based on the oxygen concentration detected at that moment, for a predetermined period of time from the end of misfire;

decreasing correction means for forcibly correcting the fuel injection quantity to be decreased for said predetermined period of time from the end of misfire; and control starting means for starting the fuel injection quantity control based on said oxygen quantity at the end of the forcible decreasing correction of said fuel injection quantity.

11. A method of controlling an air-fuel ratio of an internal combustion engine comprising the steps of:

detecting an exhaust gas quantity of said engine;

detecting an oxygen concentration in the exhaust gas at the upstream side of a catalytic converter of said engine;

estimating an oxygen quantity stored in said catalytic converter based on said exhaust gas quantity and said oxygen concentration;

feedback controlling a fuel injection quantity to said engine, so that said oxygen quantity approaches a target quantity;

detecting a misfire in said engine:

when an occurrence of misfire is detected, prohibiting said fuel injection quantity control based on the oxygen concentration detected at that moment;

prohibiting said fuel injection quantity control based on the oxygen concentration detected at that moment, for a predetermined period of time from the end of misfire;

forcibly correcting the fuel injection quantity to be decreased for said predetermined period of time from the end of misfire; and starting the fuel injection quantity control based on said oxygen quantity at the end of the forcible decreasing correction of said fuel injection quantity.

12. The method of controlling an air-fuel ratio of an internal combustion engine according to claim 11, wherein said step of prohibiting the fuel injection quantity control for the predetermined period of time from the occurrence of misfire and from the end of misfire comprises the step of;

suspending the update of the oxygen quantity in said step of estimating the oxygen quantity stored in said catalytic converter.

13. The method of controlling an air-fuel ratio of an internal combustion engine according to claim 11, wherein said step of prohibiting the fuel injection quantity control for the predetermined period of time from the occurrence of misfire and from the end of misfire comprises the step of;

stopping an operation of said step of feedback controlling the fuel injection quantity.

14. The method of controlling an air-fuel ratio of an internal combustion engine according to claim 11, further comprising the step of;

setting said predetermined period of time based on a state of misfiring.

15. The method of controlling air fuel ratio of an internal combustion engine according to claim 11, further comprising the step of:

resetting said oxygen quantity to said target quantity at the end of the forcible decreasing correction of said fuel injection quantity.

16. The method of controlling an air-fuel ratio of an internal combustion engine according to claim 11, further comprising the step of:

resetting the estimation value of said oxygen quantity to a preset value at the end of the forcible decreasing correction of said fuel injection quantity.

* * * * *